US009073373B2

(12) United States Patent
Takano et al.

(10) Patent No.: US 9,073,373 B2
(45) Date of Patent: Jul. 7, 2015

(54) CONTROL METHOD OF AND CONTROL DEVICE FOR CONTROLLING LIQUID EJECTION HEAD, AND LIQUID EJECTING APPARATUS

(75) Inventors: Koji Takano, Shiojiri (JP); Naoki Yonekubo, Shiojiri (JP); Kinya Ozawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 305 days.

(21) Appl. No.: 13/563,631

(22) Filed: Jul. 31, 2012

(65) Prior Publication Data

US 2013/0033534 A1 Feb. 7, 2013

(30) Foreign Application Priority Data

Aug. 2, 2011 (JP) ..... 2011-169621

(51) Int. Cl.
*B41J 29/38* (2006.01)
*B41J 2/045* (2006.01)

(52) U.S. Cl.
CPC ..... *B41J 29/38* (2013.01); *B41J 2/04581* (2013.01); *B41J 2/04588* (2013.01)

(58) Field of Classification Search
CPC ..... B41J 29/38; B41J 2/04588
USPC ..... 347/10
See application file for complete search history.

(56) References Cited

U.S. PATENT DOCUMENTS

| | | | | |
|---|---|---|---|---|
| 5,805,177 | A | 9/1998 | Takahashi | |
| 5,874,975 | A * | 2/1999 | Hotomi et al. | 347/70 |
| 5,980,013 | A | 11/1999 | Takahashi | |
| 6,109,716 | A | 8/2000 | Takahashi | |
| 6,145,949 | A * | 11/2000 | Takahashi | 347/14 |
| 6,357,846 | B1 * | 3/2002 | Kitahara | 347/10 |
| 6,485,133 | B1 * | 11/2002 | Teramae et al. | 347/68 |

FOREIGN PATENT DOCUMENTS

| | | |
|---|---|---|
| JP | 9-57960 | 3/1997 |
| JP | 9-201962 | 8/1997 |
| JP | 10-278269 | 10/1998 |
| JP | 2004-322318 | 11/2004 |

* cited by examiner

*Primary Examiner* — Manish S Shah
*Assistant Examiner* — Jeffrey C Morgan
(74) *Attorney, Agent, or Firm* — Workman Nydegger

(57) ABSTRACT

A drive signal includes a first drive signal and a second drive signal. The first drive signal includes a prior pulse section including a first contraction element and a discharging pulse section including a first expansion element pulling in a meniscus and the second contraction element discharging a droplet of liquid from the nozzle orifice. The second drive signal includes the discharging pulse section and a vibration control pulse section including a second expansion element controlling a residual vibration of the meniscus. A piezoelectric element is driven with the first drive signal when viscosity of the liquid is equal to or more than a first set value and is driven with the second drive signal when the viscosity is equal to or less than a second set value.

11 Claims, 7 Drawing Sheets

FIG. 8
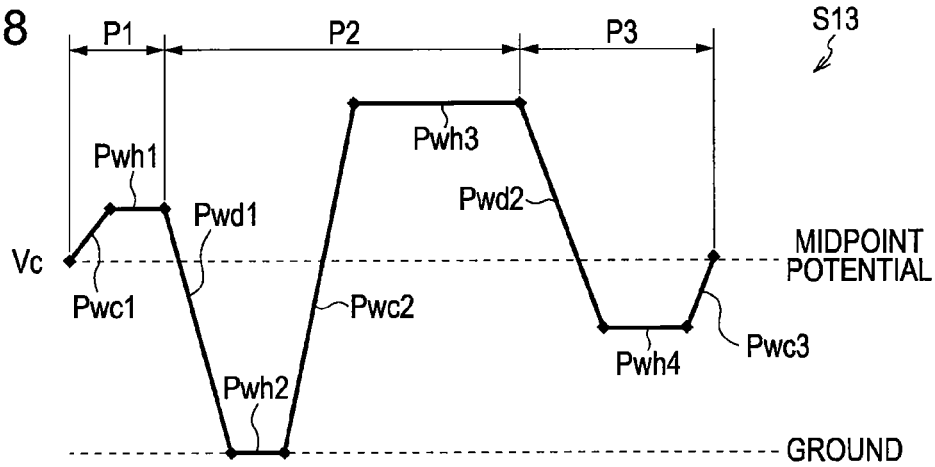
FIG. 9
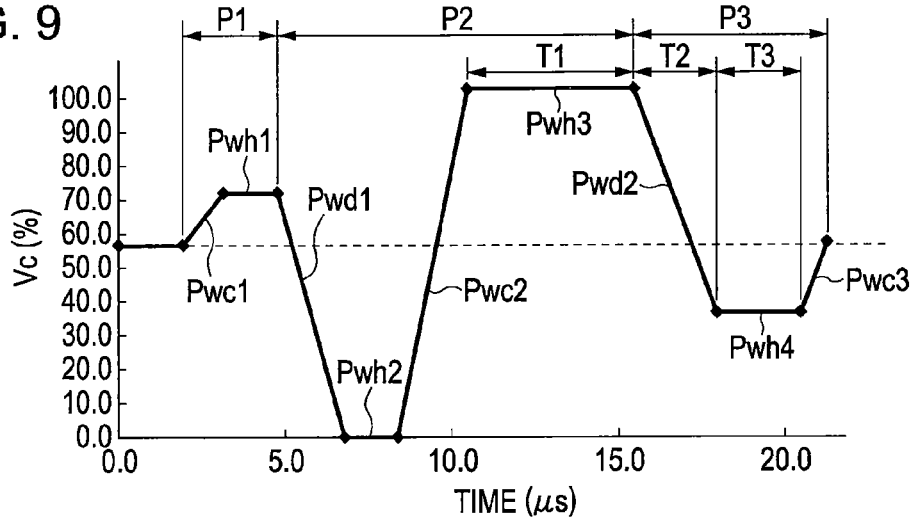
FIG. 10
| Vc (%) | TIME (μs) | WAVE FORM COMPONENT |
|---|---|---|
| 55.0 | 2.0 | |
| 55.0 | 1.2 | Pwc1 |
| 70.0 | 1.6 | Pwh1 |
| 70.0 | 2.0 | Pwd1 |
| 0.0 | 1.6 | Pwh2 |
| 0.0 | 2.2 | Pwc2 |
| 100.0 | 5.0 | Pwh3 |
| 100.0 | 2.5 | Pwd2 |
| 35.0 | 2.5 | Pwh4 |
| 35.0 | 0.8 | Pwc3 |
| 55.0 | 0.0 | |

FIG. 11A

| ΔPwh3 | | Pwh4 | | | | | | | | | |
|---|---|---|---|---|---|---|---|---|---|---|---|
| | | 0.5 | 1.0 | 1.5 | 2.0 | 2.5 | 3.0 | 3.5 | 4.0 | 4.5 | 5.0 |
| Pwd2 (μs) | 1.0 | 0.6 | 0.8 | 1.0 | 1.1 | 1.4 | 1.4 | 1.3 | 1.0 | 0.8 | 0.6 |
| | 1.5 | 0.8 | 1.0 | 1.3 | 1.4 | 1.2 | 1.4 | 1.1 | 0.8 | 0.6 | 0.3 |
| | 2.0 | 1.0 | 1.2 | 1.4 | 1.4 | 1.3 | 1.2 | 0.9 | 0.8 | 0.6 | 0.4 |
| | 2.5 | 1.1 | 1.4 | 1.6 | 1.4 | 1.1 | 0.9 | 0.9 | 0.8 | 0.5 | 0.1 |
| | 3.0 | 1.3 | 1.3 | 1.2 | 1.1 | 0.8 | 0.9 | 0.7 | 0.5 | 0.3 | 0.1 |
| | 3.5 | 1.2 | 1.2 | 1.1 | 0.9 | 0.8 | 0.6 | 0.4 | 0.3 | 0.1 | 0.1 |

FIG. 11B

| ΔPwh3 | STABILITY | COLOR |
|---|---|---|
| 1.3 OR MORE | ◎ | |
| 1.0 TO 1.2 | ○ | |
| 0.6 TO 0.9 | × | |
| LESS THAN 0.5 | ×× | |

CONTROL METHOD OF AND CONTROL DEVICE FOR CONTROLLING LIQUID EJECTION HEAD, AND LIQUID EJECTING APPARATUS

The entire disclosure of Japanese Patent Application No. 2011-169621, filed Aug. 2, 2011 is expressly incorporated by reference herein.

BACKGROUND

1. Technical Field

The present invention relates to a control method of and a control device for controlling a liquid ejection head, and a liquid ejecting apparatus and is particularly useful for application in discharging a liquid of which the viscosity changes over a wide range.

2. Related Art

An ink jet recording head which discharges a droplet of ink from its nozzle orifice, for example, using pressure by displacement of a piezoelectric actuator, is known as a typical example of a liquid ejection head discharging liquid through its nozzle orifice, which is installed in a liquid ejecting apparatus. In general, this kind of ink jet recording head has a configuration in which a piezoelectric actuator is provided on one side of a flow channel formation substrate on which a pressure generation room communicating with the nozzle orifice is formed, and the droplet of ink is discharged from the nozzle orifice by applying pressure to ink in the pressure generation room by changing the form of this piezoelectric actuator.

Among the ink jet recording devices equipped with the ink jet recording head, there is one which uses ink whose fixing is facilitated by heat. A heater for drying and fixing ink is built into the ink jet recording head of this kind of ink jet recording device. In this case, the temperature of the ink within the ink jet recording head changes over a wide range from low to high, due to the influence of the heater. Therefore, the viscosity of the ink also changes over a wide range. At this point, discharge characteristics of the ink vary greatly with the influence of the viscosity. Therefore, when discharging the ink whose viscosity varies over a wide range with a drive signal with one kind of fixed waveform, there is a problem in that the imbalance between the weight of discharged ink and the speed of the ink causes deterioration in the discharge characteristics.

A drive waveform is disclosed in JP-A-2004-322318, in which a prior pulse section is provided preceding a discharging pulse section with which a droplet of ink is discharged from the nozzle orifice and a vibration control pulse section is provided following the discharging pulse section.

In JP-A-2004-322318, a configuration is disclosed in which the vibration generated to the ink with the prior pulse section is used and the droplet of ink is discharged, with being synchronized with that vibration, in order to reduce the voltage level of the drive signal and suppress dispersion of the discharge of the droplets of ink.

However, in JP-A-2004-322318, the relationship between the viscosity of ink and the drive waveform is not disclosed and there is also a problem in that in a case of high viscosity ink, vibration of a pressure generation room and vibration of meniscus cannot be completely synchronized. That is, the accuracy cannot be secured in the discharge characteristic according to the viscosity changing over a wide range.

This problem occurs not only in the ink jet recording head, but also in a liquid ejection head ejecting liquid other than ink.

SUMMARY

An advantage of some aspects of the invention is to provide a control method of, and a control device for, controlling a liquid ejection head which is capable of securing stability of the discharge characteristics, although the viscosity of liquid changes over a wide range, by driving a pressure generation unit with a proper drive signal according to the viscosity, and a liquid ejecting apparatus.

According to an aspect of the invention, there is provided a control method of controlling a liquid ejection head discharging liquid within a pressure generation room, through a nozzle orifice by generating pressure change to the liquid within the pressure generation room with a pressure generation unit that is driven with a drive signal, in which the drive signal includes a first drive signal and a second drive signal, and in which the first drive signal includes a prior pulse section including a first contraction element contracting the pressure generation room and a discharging pulse section including a first expansion element pulling in a meniscus by expanding the pressure generation room following the first contraction element and a second contraction element discharging a droplet of liquid from the nozzle orifice by contracting the pressure generation room following the corresponding first expansion element, and the second drive signal includes the discharging pulse section and a vibration control pulse section including a second expansion element controlling a residual vibration by expanding the pressure generation room following the second contraction element, including driving the pressure generation unit with the first drive signal when viscosity of the liquid is equal to or more than a first set value and driving the pressure generation unit with the second drive signal when the viscosity is equal to or less than a second set value which is lower than the first set value.

In this aspect, because the first drive signal which is used when discharging a given high viscosity liquid includes the prior pulse section, the meniscus which is given pressure in the direction of the nozzle orifice with the first contraction element, may be pulled in, in the opposite direction with the first expansion element of the next discharging pulse. That is, the meniscus, which is given momentum with the first expansion section, may be pulled in at a stroke with the first expansion element. As a result, although the liquid has a high viscosity, the pulling-in operation of the meniscus with the discharging pulse section may be favorably performed by the presence of the prior pulse section.

Furthermore, because the second drive signal, which is used when discharging a given low viscosity liquid, includes the vibration control pulse section, the vibration accompanying the return of the meniscus of the liquid discharged from the nozzle orifice with the second contraction element may be absorbed by the expansion of the pressure generation room with the second contraction element. As a result, although the liquid is of low viscosity, the vibration of the meniscus with the vibration control pulse section may be favorably suppressed by the presence of the vibration control pulse section.

The drive signal may further include a third drive signal including the prior pulse section, the discharging pulse section and the vibration control pulse section, and the pressure generation unit is driven with the third drive signal when the viscosity of the liquid is less than the first set value and exceeds the second set value. In this case, it is also possible to perform a straight line supplement which corresponds to the viscosity of the liquid between the first drive signal and the second drive signal, and the drive signal may correspond to more accurate viscosity, including, for example, the viscosity which is in the middle range but is nearer to high, and the viscosity which is in the middle range but is nearer to low.

According to another aspect of the invention, there is provided a control device for controlling a liquid ejection head discharging liquid within a pressure generation room through a nozzle orifice by generating pressure change to the liquid within the pressure generation room with a pressure generation unit that is driven with a drive signal, in which the drive signal includes a first drive signal and a second drive signal, in which the first drive signal includes a prior pulse section including a first contraction element contracting the pressure generation room and a discharging pulse section including a first expansion element pulling in a meniscus by expanding the pressure generation room following the first contraction element and a second contraction element discharging a droplet of liquid from the nozzle orifice by contracting the pressure generation room following the corresponding first expansion element, and the second drive signal includes the discharging pulse section and a vibration control pulse section including a second expansion element controlling a residual vibration by expanding the pressure generation room following the second contraction element, and in which the pressure generation unit is driven with the first drive signal when viscosity of the liquid is equal to or more than a first set value and the pressure generation unit is driven with the second drive signal when the viscosity is equal to or less than a second set value which is lower than the first set value.

In this aspect, as in the above aspect, although the liquid is of high viscosity, the pulling-in operation of the meniscus with the discharging pulse section may be favorably performed by the presence of the prior pulse section, and although the liquid is of low viscosity, the vibration of the meniscus with the vibration control pulse section may be favorably suppressed by the presence of the vibration control pulse section.

In this aspect, a configuration is preferable in which the drive signal further includes a third drive signal including the prior pulse section, a discharging pulse section and a vibration control pulse section, and the pressure generation unit is driven with the third drive signal when the viscosity of the liquid is less than the first set value and exceeds the second set value which is lower than the first set value. In this case, as in the above aspect, the drive signal may correspond to more accurate viscosity, including, for example, the viscosity which is in the middle range but is nearer to high, and the viscosity which is in the middle range but is nearer to low.

Furthermore, the sum of a first period from the starting point of the second expansion element to the ending point and a second period from the starting point of a leveling element during which the pressure generation unit is uniformly maintained, following the second expansion element, to the ending point, in the vibration control pulse section, may be determined as ($5/13$) Tc to ($10/13$) Tc, when the cycle of natural vibration of the pressure generation room is defined as Tc. In this case, because the time sum of the first period and the second period is approximately (Tc/2), the second expansion element and the third contraction element returning to their initial states continuous with the leveling element increase vibration and vibration control force suppressing the meniscus vibration is great, thereby favorably suppressing residual vibration to low-viscosity ink, too. That is, an effect of the most stable control is obtained in the relationship with Tc.

Furthermore, the relationship may be D2≥D1, between a slope D1 of the first expansion element and a slope D2 of the second expansion element in the waveform of the drive signal. In this case, the satisfactory effect of vibration control can be obtained because the slope at the time of pulling in the meniscus for vibration control after discharging is equal to or more than the slope at the time of pulling in the meniscus before discharging. Furthermore, the relationship may be D3≥D4, between a slope D3 of the first contraction element in the waveform of the drive signal and a slope D4 of the third contraction element that returns to its initial state following the leveling element of the vibration control pulse section. In this case, the excellence in the discharge and vibration control characteristics may be secured because the slope at the time of discharging liquid is equal to or more than the slope at the time of controlling the vibration of the meniscus accompanying the returning to the initial state at the time of controlling vibration.

According to a still another aspect of the invention, there is provided a liquid ejecting apparatus including a pressure generation room filled with liquid, a pressure generation unit causing a pressure change to the liquid within the pressure generation room by supplying a drive signal, a liquid ejection head including a nozzle orifice from which the liquid within the pressure generation room is discharged according to the pressure change, and the control device for controlling the liquid ejection head.

In this aspect, because the liquid can be discharged with more accurate drive waveforms that are suitable for a wide range of viscosities from high to low, the speed of discharged liquid and the amount of discharged liquid may be stable, and excellent discharge characteristics may be obtained, thereby improving the quality of the printing or the like.

BRIEF DESCRIPTION OF THE DRAWINGS

The invention will be described with reference to the accompanying drawings, wherein like numbers reference like elements.

FIG. 8 is a waveform chart illustrating a waveform of a third drive signal of the liquid ejecting apparatus according to an aspect of the invention.

FIG. 9 is a waveform chart illustrating a waveform of a drive signal which verifies a vibration control function of the liquid ejecting apparatus.

FIG. 10 is a table listing data which is obtained as a result of verification of the vibration control function.

FIGS. 11A and 11B are tables showing the stability in the discharge which is obtained as a result of verification of the vibration control function.

DESCRIPTION OF EXEMPLARY EMBODIMENTS

Referring to drawings, the aspect of the invention will be described below.

Figure 1:
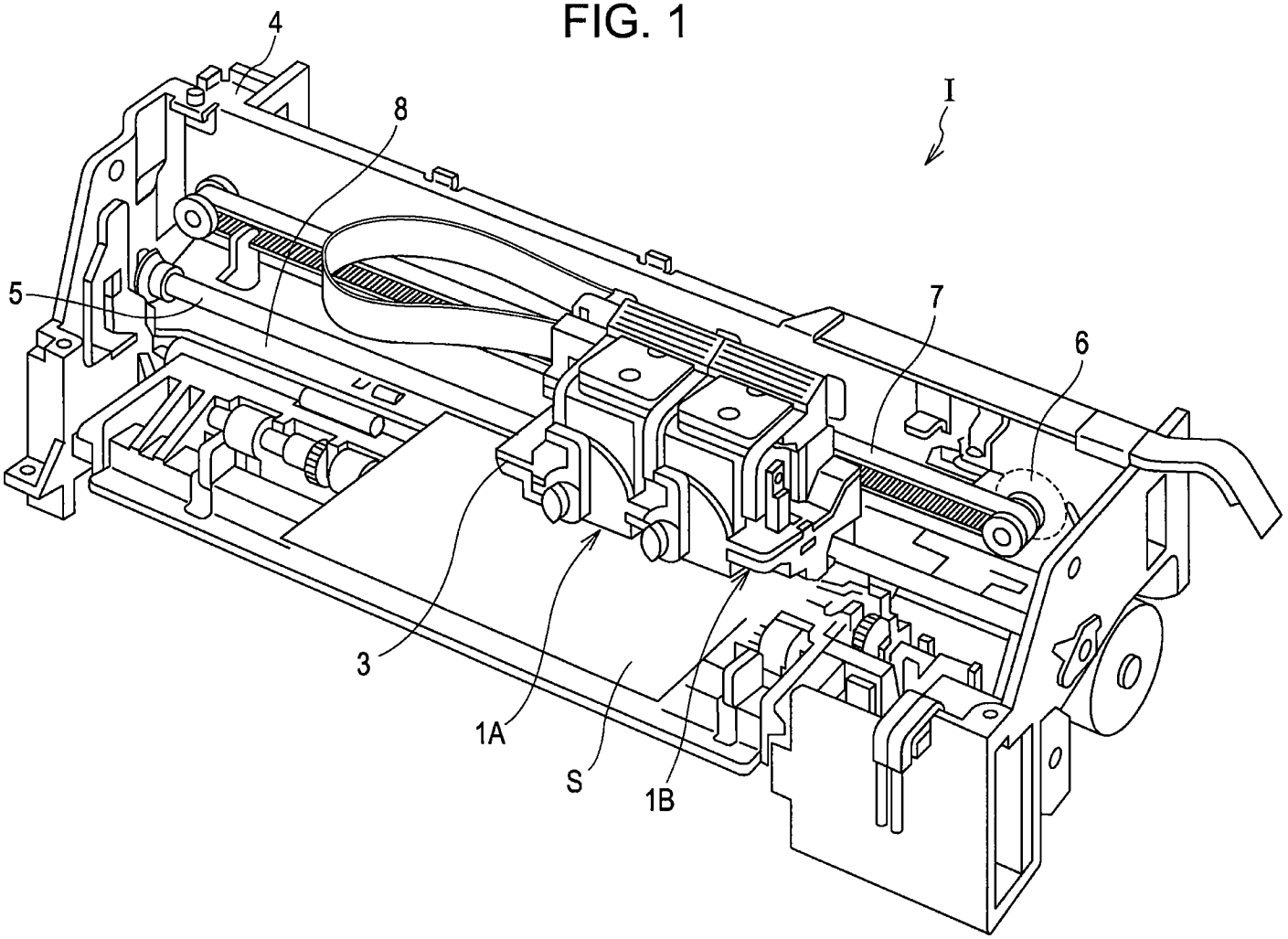
FIG. 1 is a perspective schematic view illustrating a configuration of a liquid ejecting apparatus.

FIG. 1 is a schematic diagram illustrating one example of an ink jet recording device (hereinafter referred to as 'recording device'). As shown in FIG. 1, recording head units 1A and 1B are installed in an ink jet recording device I as a liquid discharging device. The recording head units 1A and 1B are mounted on a carriage 3 of the ink jet recording device I, and the carriage 3 is installed on the carriage shaft 5 installed in the main body 4 of the ink jet recording device I, in a manner to move in the shaft direction. Each of the recording head units 1A and 1B, for example, discharges a black ink composition and a color ink composition. The fixing of the ink used in the aspect may be facilitated by heat.

A carriage 3 on which the recording head units 1A and 1B are mounted is moved along the carriage shaft 5, by a driving force of a drive motor 6 being transferred to the carriage 3 through a plurality of cogs (not shown) and a timing belt 7. On the other hand, a platen 8 is provided along the carriage shaft 5 in the main body 4, and a recordable sheet S, which is a recordable media, for example, a paper sheet, supplied by, for example, a paper feed roller not shown in FIG. 1, is wound around the platen 8 and is then conveyed. Furthermore, since the recording device I according to the aspect uses ink whose the fixing is facilitated by heat, a heater, not shown in FIG. 1, is embedded inside the recording head units 1A and 1B to dry and fix the ink. In this case, the temperature of the ink within the ink jet recording head changes over a wide range from high to low because of the temperature of the heater or the environmental temperature. Therefore, the viscosity of the ink varies accordingly over a wide range.

Figure 2:
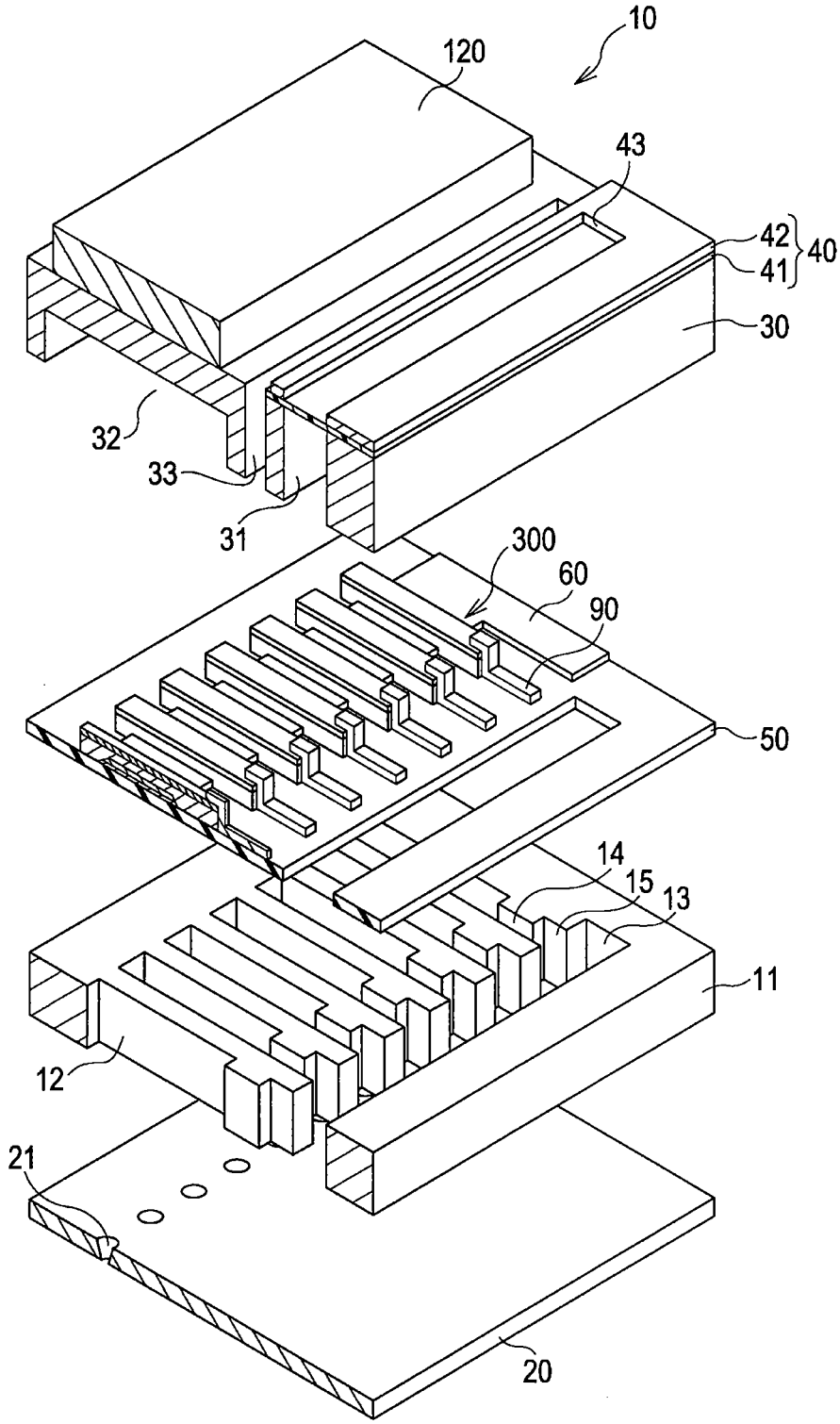
FIG. 2 is a perspective exploded view illustrating an overall configuration of a recording head according to an aspect.
Figure 3:
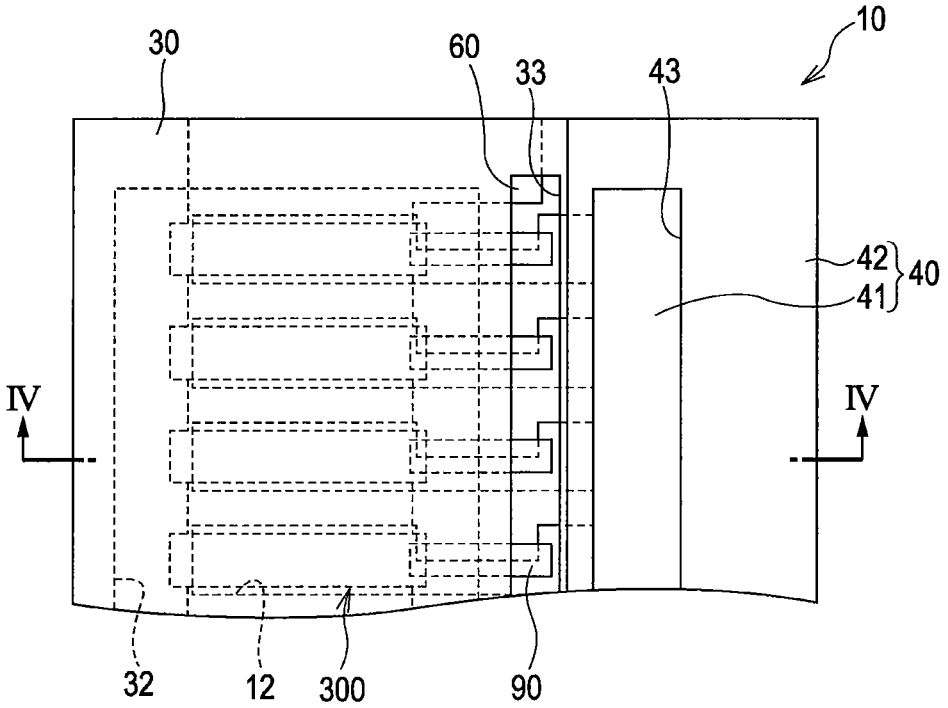
FIG. 3 is a plan view of FIG. 2.
Figure 4:
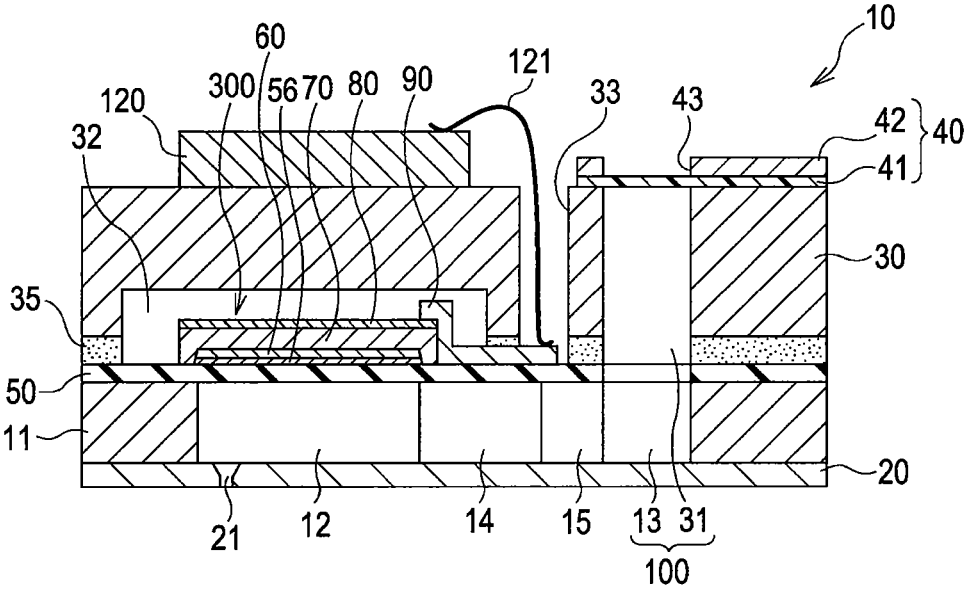
FIG. 4 is a cross-sectional view taken along a line IV-IV in FIG. 3.

FIG. 2 is a perspective exploded view illustrating an overall configuration of the ink jet recording head (hereinafter referred to as 'recording head') where the recording head units 1A and 1B, as shown in FIG. 1, are embedded. FIG. 3 is a plan view of FIG. 2. FIG. 4 is a cross-sectional view taken along a line IV-IV in FIG. 3.

As shown in FIGS. 2 to 4, a flow channel formation substrate 11 of the recording head 10 is made from a silicon monocrystalline substrate. A surface of one side of the silicon monocrystalline substrate is made from silicon dioxide, and in the aspect, an elastic film 50, which becomes a vibration section, is formed on the surface of one side of the silicon monocrystalline substrate. A plurality of pressure generation rooms 12 are arranged in parallel on the flow channel formation substrate 11, in the width direction of the flow channel formation substrate 11. Furthermore, a communication section 13 is formed in an area outside of the longitudinal direction of the pressure generation room 12 of the flow channel formation substrate 11, and the communication section 13 and each pressure generation room 12 communicate with each other through an ink supply channel 14 and a communication channel 15 which are provided in each of the pressure generation rooms 12. The communication section 13 communicates with a manifold section 31 of a protection substrate 30, as described below, and thus makes up one part of a manifold 100 which becomes a common ink room of each pressure generation room 12. The ink supply channel 14 is formed more narrowly in width than the pressure generation room 12, and thus the resistance to the flow of the ink from the communication section 13 into the pressure generation room 12 may be uniformly maintained. In the aspect, the ink supply channel 14 is formed, with the width of the flow channel being narrowed from one side, but may be formed, with the width of the channel being narrowed from both sides. Furthermore, the ink supply channel may be formed by narrowing in the thickness direction of the flow channel, instead of by narrowing the width of the flow channel. In this way, in the aspect, a liquid channel, which is made from the pressure generation room 12, the communication section 13, the ink supply channel 14, and the communication channel 15, is provided in the flow channel formation substrate 11, and the pressure generation room 12 is filled with ink.

A nozzle plate 20 is fixed to the aperture surface, which is, a surface of one side of the flow channel formation substrate 11, using an adhesive, or a thermal welding film. A nozzle orifice 21, which communicates with the vicinity of the end of the side, opposite to the ink supply channel 14, of each of the pressure generation room 12, is pierced through the nozzle plate 20. At this point, the nozzle plate 20 may be suitably configured by, for example, glass ceramics, silicon monocrystalline substrate, stainless steel, and others.

The elastic film 50, as described above, is formed to the aperture surface, which is, a surface of the opposite side of the flow channel formation substrate 11. An adhesion layer 56 is provided on the elastic film 50, to improve adhesion between, for example, a first electrode 60 made from, for example, titanium oxide with a thickness of approximately 30 nm to 50 nm and a foundation of the first electrode 60 of the elastic film 50. Furthermore, an insulator film, made from, for example, zirconium oxide, may be provided on the elastic film 50, if necessary.

Furthermore, the first electrode 60, a piezoelectric layer 70, which is a thin film with the thickness of equal to or less than 2 μm, preferably, a range of 0.3 μm to 1.5 μm, and a second electrode 80 are laminated onto this adhesion layer 56, thereby configuring a piezoelectric element 300. The piezoelectric element 300 is a unit which generates pressure in the aspect, and also an element which includes the first electrode 60, the piezoelectric layer 70, and the second electrode 80. Generally, either side of the piezoelectric element 300 is configured by making one electrode of the piezoelectric element 300 a common electrode and by performing the patterning of the other electrode and the piezoelectric layer 70 with respect to each pressure generation room 12. In the aspect, the first electrode 60 is the common electrode of the piezoelectric element 300, and the second electrode 80 is an individual electrode of the piezoelectric element 300. However, this arrangement may be reversed depending on the condition of a drive circuit, or wiring, without causing any problems. At this point, the piezoelectric element 300, and a vibrating plate where displacement is generated by the drive of the corresponding piezoelectric element 300, are referred to in combination as an actuator device. In the example described above, the elastic film 50, the adhesion layer 56, the first electrode 60, and the insulator film, which is provided if necessary, operate as the vibrating plate. However, the elastic film 50 and the adhesion layer 56 may not be provided for example, rather than being limited to this configuration. Furthermore, the piezoelectric element 300 itself may concurrently do an additional job of substantially serving as the vibrating plate.

A lead electrode 90 is connected to the second electrode 80 which is the individual electrode of the piezoelectric element 300. The lead electrode 90 made from, for example, gold (Au), extends from the vicinity of the end, positioned in the direction of the ink supply channel 14, of the piezoelectric element 300 to above the elastic film 50, or above the insulator film, provided if necessary.

The protection substrate 30 having the manifold section 31 making up at least a section of the manifold 100 is attached, with an adhesive agent 35 in between, to the flow channel formation substrate 11 on which the piezoelectric element 300 is formed, positioned over the first electrode 60, the elastic film 50, the insulator film provided if necessary, and the lead electrode 90. In the aspect, the manifold section 31 pierces the protection substrate 30 in the thickness direction, extends in the width direction of the pressure generation room 12, communicates with the communication section 13 of the flow channel formation substrate 11, as described above, and makes up the manifold 100 which is the common ink room of each pressure generation room 12. Furthermore, the communication section 13 of the flow channel formation substrate 11 are divided into the multiple communication sections to correspond to each pressure generation room 12, and the manifold section 31 only may be referred to as the manifold. Furthermore, for example, only the pressure generation room 12 is provided in the flow channel formation substrate 11, and the manifold 100 and the ink supply channel 14 which communicates with each pressure generation room 12 are provided in a member (for example, the elastic film 50, the insulator film, provided if necessary) interposed between the flow channel formation substrate 11 and the protection substrate 30.

Furthermore, a piezoelectric element holding section 32, which occupies such a space that does not interfere with the motion of the piezoelectric element 300 is provided in an area facing the piezoelectric element 300 of the protection substrate 30. As long as the piezoelectric element holding section 32 has such a space that does not interfere with the motion of the piezoelectric element 300, and the corresponding space may be sealed, or may be not sealed.

The protection substrate 30 may be preferably formed using a material with almost the same thermal expansion coefficient as the flow channel formation substrate 11, for example, glass, or a ceramic material. In the aspect, the protection substrate 30 is formed using the silicon monocrystalline substrate having the same material as the flow channel formation substrate 11.

Furthermore, a pierced hole 33, which is pierced through the protection substrate 30 in the thickness direction, is provided in the protection substrate 30, and the vicinity of the end of the lead electrode 90 extending from the piezoelectric element 300 is configured to be exposed within the pierced hole 33.

On the other hand, a drive circuit 120 driving the piezoelectric element 300, controlled by a control device, which is described below, (not shown in FIGS. 2 to 4), is fixed to the protection substrate 30. For example, a circuit board or a semiconductor integrated circuit (IC) may be used as the drive circuit 120. Therefore, the drive circuit 120 and the lead electrode 90 are electrically connected with each other through an electric wire 121 which is made from a conductive wire, for example, a bonding wire.

A compliance substrate 40, which is made up of the sealing film 41 and the fixing plate 42 is fixed to the protection substrate 30. The sealing film 41 is made from a flexible material, low in rigidity, and seals one side of the manifold section 31. The fixing plate 42 is formed using a material which is comparatively high in rigidity. Because an area, opposite to the manifold 100, of the fixing plate 42 is an opening section 43 where the fixing plate 42 is completely removed in the thickness direction, one side of the manifold 100 is sealed by the flexible sealing film 41 only.

In this recording head 10, the inside is filled, from the manifold 100 to the nozzle orifice 21, with ink supplied from an ink inlet connecting to an outside ink supply unit (not shown). Thereafter, a voltage is applied between the first electrode 60 and the second electrode 80 which corresponds to the pressure generation room 12, according to the drive signal from the drive circuit 120. In this way, the bending change was made to the elastic film 50, the adhesion layer 56, the first electrode 60, and the piezoelectric layer 70, and the vibration caused by this bending deformation is transferred to the ink within each pressure generation room 12, through elastic film 50 which serves as the vibration section. As a result, pressure within each pressure generation room 12 rises, and thus droplets of ink are discharged from the nozzle orifice 21. This drive operation of discharging ink is described below.

Figure 5:
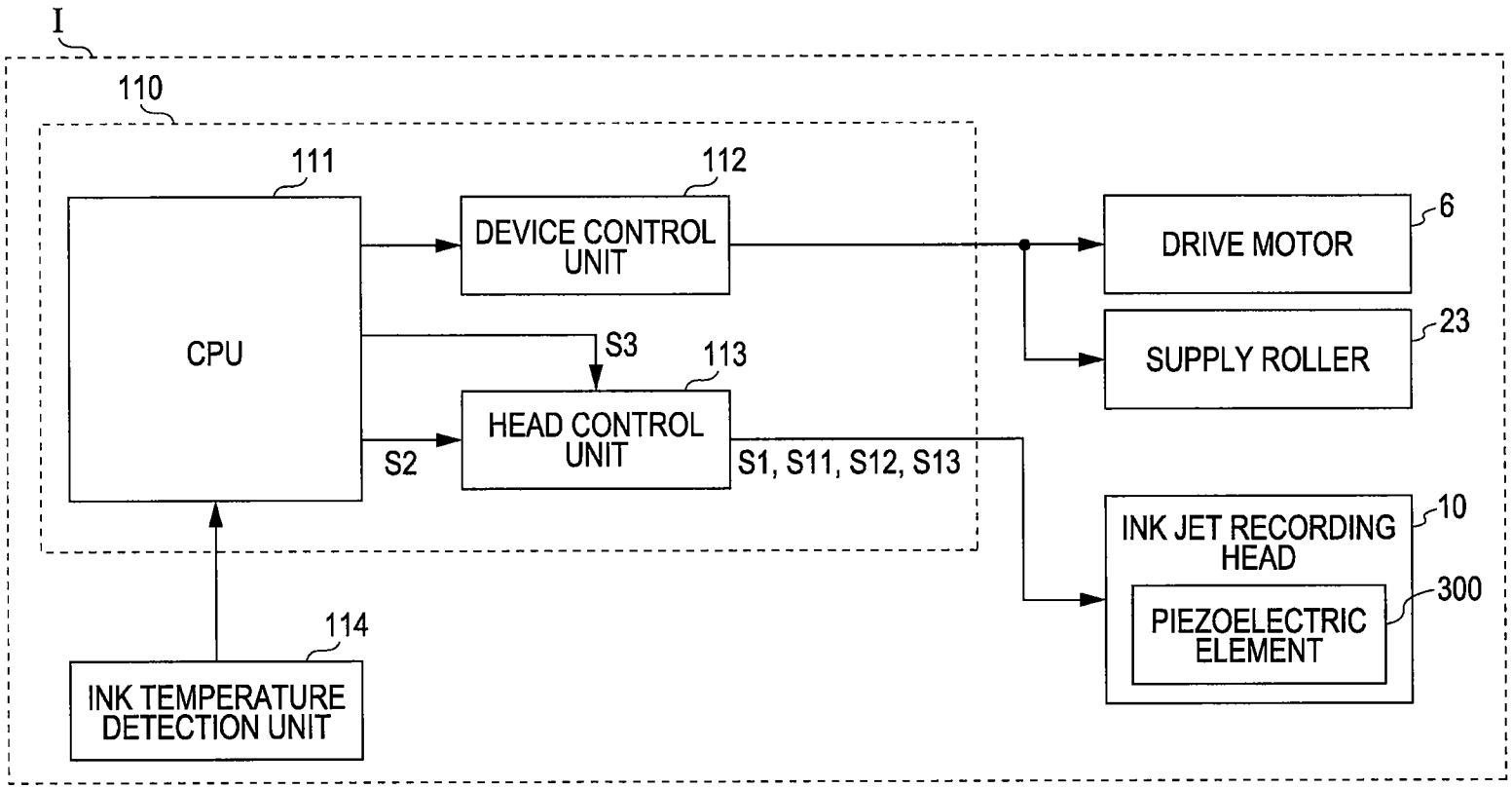
FIG. 5 is a block diagram illustrating a configuration of a control system of a liquid ejecting apparatus.

FIG. 5 is a block diagram illustrating a control system of the ink jet recording device I. As shown in FIG. 5, a control device 110 for performing the control of the ink jet recording device I is provided within the ink jet type recording device I. The control device 110 includes a CPU 111, a device control unit 112, a head control unit 113 which is a drive circuit of a piezoelectric element 300, which has a capacitive load.

More specifically, when a signal indicating motion of the carriage 3 (refer to FIG. 1) is input into the device control unit 112 from the CPU 111, the device control unit 112 moves the carriage 3 along the carriage shaft 5 by driving the drive motor 6, and when a signal indicating conveyance of the recordable sheet S (refer to FIG. 1) is input into the device control unit 112 from the CPU 111, the device control unit 112 conveys the recordable sheet S (refer to FIG. 1) by driving a supply roller 23.

On the other hand, an analog signal S2 for generating a drive signal S1 for the head and a control signal S3 for controlling operation of the corresponding head control unit 113, which are coming from the CPU 111, are input into the head control unit 113. As a result, the head control unit 113 selectively applies the drive signal S1 to each piezoelectric element 300 of the ink jet recording head 10, and thus discharges the ink. At this point, the ink jet recording head 10 selectively drives the piezoelectric element 300 because a head control signal from the CPU 111 is supplied to a driver IC not shown in figures.

At this point, the head control unit 113 selects 3 kinds of drive signals S1 consisting of a first drive signal S11, a second drive signal S12, and a third drive signal S13, based on viscosity of the ink, and suitably drives the piezoelectric element 300. That is, the temperature of the ink is detected in an ink temperature detection unit 114, and this information is sequentially supplied to the CPU 111. The CPU 111 controls the head control unit 113 to supply the drive signal S1 according to the viscosity, because the viscosity of the ink is detected based on the detected temperature of the ink. The waveforms of the first to third drive signals S11, S12, and S13 which are formed at this time are shown in FIGS. 6 to 8, respectively.

Figure 6:
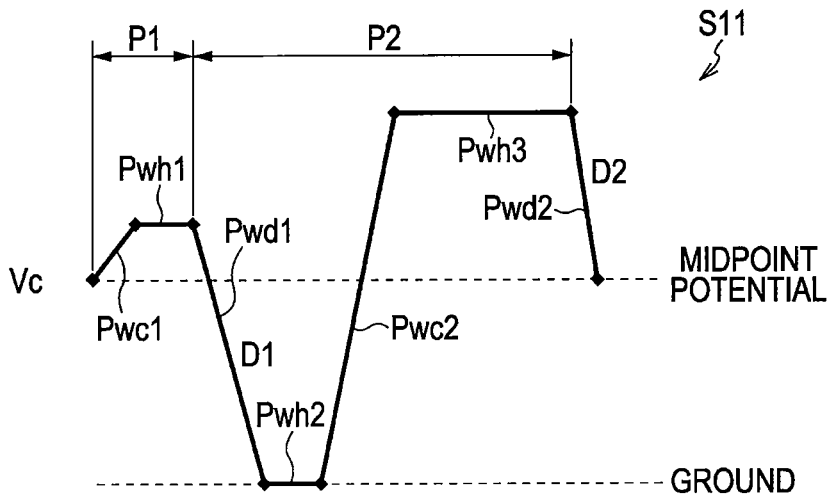
FIG. 6 is a waveform chart illustrating a waveform of a first drive signal of the liquid ejecting apparatus according to an aspect of the invention.

As shown in FIG. 6, the first drive signal S11 includes a prior pulse section P1 and a discharging pulse section P2. The prior pulse section P1 includes a first contraction element Pwc1 contracting the pressure generation room 12. The discharging pulse section P2 includes a first expansion element Pwd1 pulling in a meniscus by expanding the pressure generation room 12 following the first contraction element Pwc1 and a second contraction element Pwc2 discharging a droplet of ink from the nozzle orifice 21 by contracting the pressure generation room 12 following the first expansion element Pwd1. That is, the prior pulse section P1 is included to easily pull in the meniscus and is applied when discharging high viscosity ink.

Figure 7:
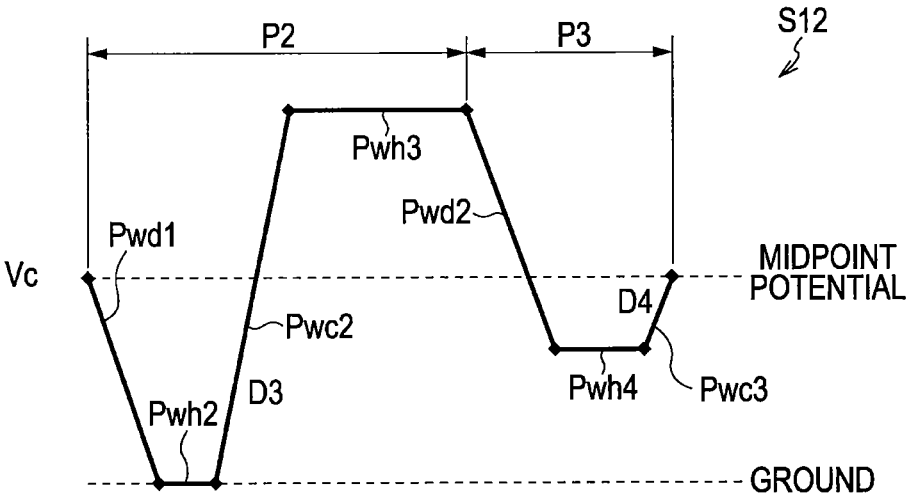
FIG. 7 is a waveform chart illustrating a waveform of a second drive signal of the liquid ejecting apparatus according to an aspect of the invention.

The second drive signal S12, as shown in FIG. 7, includes the discharging pulse section P2 and a vibration control pulse section P3 including a second expansion element Pwd2 controlling a residual vibration by expanding the pressure generation room 12 following the second contraction element Pwc2. That is, the vibration control pulse section P3 is included to suppress the vibration of the meniscus which accompanies the droplet of ink being discharged with the second contraction element Pwc2, and is applied when discharging low viscosity ink.

The third drive signal S13 as shown in FIG. 8, includes all of the pulse sections consisting of the prior pulse section P1, the discharging pulse section P2, and the vibration control pulse section P3. Therefore, the third drive signal S13 is applied when discharging ink whose the viscosity is halfway between high and low. Specifically, the third drive signal S13 is useful for doing linear supplementation on the viscosity of the ink which is somewhere between high and low. In this case, the third drive signal S13 may correspond to more accurate viscosity, including, for example, the viscosity which is in the middle range but is nearer to high and the viscosity which is in the middle range but is nearer to low.

In FIGS. 6 to 8, Pwh1, Pwh2, Pwh3, and Pwh4 are leveling elements each of which is held uniform to link the contraction element and the expansion element, and Pwc3 is a third contraction element for controlling the vibration.

The CPU 111 controls the head control unit 113 to cause the head control unit 113 to supply the first signal S11 to the piezoelectric element 300, when the viscosity is equal to or more than a first set value Th1 for nearer-to-high viscosity, and to supply the second signal S12 to piezoelectric element 300, when the viscosity is equal to or less than a second set value Th2 for nearer-to-low viscosity, according to the detected viscosity of the ink. The CPU 111 controls the head control unit 113 to cause the head control unit 113 to supply the third drive signal S13 to the piezoelectric element 300 when the viscosity of ink is less than the first set value Th1 and exceeds the second set value Th2.

At this point, in the aspect, the relationship is D2≥D1 between a slope D1 of the first expansion element Pwd1 and a slope D2 of the second expansion element Pwd2 in the first drive signal S11. In this way, because the slope at the time when the meniscus is pulled in to control vibration after discharging can be made to be equal to, or more than the slope at the time when the meniscus is pulled in before discharging, the satisfactory effect of vibration control after discharging a droplet of ink may obtained.

Furthermore, the relationship is D3≥D4 between a slope D3 of the second contraction element Pwc2 in the second drive signal S12 and a slope D4 of the third contraction Pwc3 that returns to its initial state following a leveling element Pwh4 in the vibration control pulse section P3. In this way, because the slope at the time of discharging can be made to be equal to or more than the slope at the time of returning to the initial state when controlling the vibration, the satisfactory effect of controlling the vibration as well as the excellence in the discharge characteristic may be obtained.

Furthermore, the sum of a period from the starting point of the second expansion element Pwd2 to the ending point and a period from the starting point of the leveling element Pwh4 following the second expansion element Pwd2 to the ending point in the vibration control pulse section P3 is determined as (5/13) Tc to (10/13) Tc, when the cycle of the natural vibration of the pressure generation room 12 is defined as Tc. In this case, referring to FIGS. 9 to 11B, the most stable vibration control effect may be obtained in terms of the relationship with Tc, as described below.

FIG. 9 is a waveform chart illustrating a drive pulse which is used to validate the stability of the discharge in the vibration control pulse section P3. In this case, the signal with the same waveform as in the third drive signal S13 is used and voltages (Vc) and periods (μs) for each wave unit are shown in FIG. 10. A period T2 from the starting point of the second expansion element Pwd2 to the ending point and a period T3 from the starting point of the leveling element Pwh4 to the ending point following the second expansion element Pwd2 are adjusted as shown in FIG. 11A when the cycle Tc of the natural vibration of the pressure generation room 12 is 6.5 (μsec), and the experiment was performed to measure a period T1 (ΔPwh3) which is an index of discharge stability under each of the conditions. At this point, the period T1 (ΔPwh3) is a time length of the leveling element Pwh3 during which it is possible to obtain the stable discharge. That is, for example, the period T1 (ΔPwh3) is 1.0 μs if the stable discharge can be obtained with the leveling element Pwh3 when the leveling element Pwh3 is 4.5 μs to 5.5 μs.

The result of the experiment described above, as shown in FIGS. 11A and 11B shows that when the discharge was performed by adjusting the length of the period T1 (ΔPwh3), with a sum of the period T2 of the second expansion element Pwd2 and the period T3 of the leveling element Pwh4 being in a range of (5/13) Tc to (10/13) Tc and the result was checked, the length of the period T1 (ΔPwh3) during which to obtain the stable discharge was equal to or more than 1 μs, and the stable discharge could be secured. It is assumed that the reason why the range in which the discharge stability is good deviates from (Tc/2) is because it takes time for the ink to act with respect to the movement of the piezoelectric element 300. In this way, when (T2+T3) is in a range of (5/13) Tc to (10/13) Tc with (Tc/2) in between, the second expansion element Pwd2 and the third contraction Pwc3 increase vibration, and the vibration control force suppressing meniscus vibration becomes greater and the residual vibration to low-viscosity ink may be favorably suppressed although the viscosity of ink is low.

It is determined that the range in which to secure the stable discharge when adjusting the length of the period T1 (ΔPwh3) is equal to or more than 1 μs. The reason behind this determination is as follows. That is, there is the likelihood that a dispersion of the natural vibration cycle Tc of the pressure generation room 12, resulting from a dispersion of the manufacture of the head might exist or an error in the time length of a waveform, resulting from the control accuracy might occur. Therefore, preferably, the period T1 (ΔPwh3) has to be greater in length to compensate for this kind of dispersion and secure the stable discharge.

From the past experiment, it is known that the problem does not occur to the product when the period T1 (ΔPwh3) is about 1 μs. More specifically, the residual vibration of the meniscus of the ink discharged with the second contraction element Pwc2 is controlled through the leveling element Pwh3 during the vibration control pulse section P3, but the interval from the ending point of the second contraction element Pwc2 to the starting point of the second expansion element Pwd2 is very important to perform effective vibration control. A dispersion of the characteristic of the head, a dispersion of the drive signal S1 and others have to be considered in determining this interval. If the range in which to secure the stable discharge is equal to or more than a minimum of 1 μsec when the length of the period T1 (ΔPwh3) is adjusted, this means that the dispersion described above may be compensated for, and thus the effective function of vibration control may be desirably performed.

As described above, in the aspect, since the first drive signal S11 includes the prior pulse section P1, the meniscus, which is given pressure in the direction of the nozzle orifice 21 with the first contraction element Pwc1, may be pulled in, in the opposite direction with the first expansion element Pwd1 of the next discharging pulse section P2. That is, the meniscus, which is given momentum with the prior pulse section P1, may be pulled in at a stroke with the first expansion element Pwd1. As a result, although the high viscosity ink whose the viscosity is equal to or more than the first set value Th1, the pulling-in operation of the meniscus with the discharging pulse section P2 is favorably performed by the presence of the prior pulse section P1, and thus the stable operation of discharging the ink with the second contraction element Pwc2 may be secured.

Furthermore, since the second drive signal S12 includes vibration control pulse section P3, the residual vibration accompanying the return of the meniscus of the ink discharged from the nozzle orifice 21 with the second contraction element Pwc2 may be absorbed by the pressure generation room 12 being expanded with second expansion element Pwd2. As a result, even though the viscosity of the ink is low, the vibration of the meniscus after discharging the ink may be favorably suppressed.

Furthermore, since the third drive signal S13 includes all of the elements consisting of the prior pulse section P1, the discharging pulse section P2, and the vibration control pulse section P3, the adequacy in the discharge characteristic is secured when the viscosity of the ink is in a middle range.

Other Aspects

The aspect of the invention is described above, but the principle configuration of the aspect of the invention is not limited to this description. For example, the third drive signal S13 is not necessarily required. It is because the discharging pulse section is required at a minimum if the viscosity is in the middle range. When the third drive signal S13 is formed, it is possible to perform the drive of the piezoelectric element 300 which corresponds to more accurate viscosity, including, for example, the viscosity which is in the middle range but is nearer to high and the viscosity which is in the middle range but is nearer to low.

In the aspect described above, the recording device I is described as including the piezoelectric actuator using the thin film piezoelectric element as a pressure generation device generating a change in the pressure in the pressure generation room 12, but is not limited to this configuration. For example, it is possible to use a thin film piezoelectric actuator, formed using a method of, for example, attaching a green sheet, or a piezoelectric actuator using a longitudinal vibration piezoelectric element which expands and contracts layers formed by alternately laminating a piezoelectric material and an electrode formation material, in the shaft direction. Furthermore, the recording device I is not limited to including the heater for fixing the ink. However, reasonably, the heater is effective in a case in which the temperature of ink changes over a wide range, and therefore the viscosity of ink accordingly changes over a wide range.

Furthermore, the aspect as shown in FIG. 1 is what is called a serial ink jet recording device which is equipped with the recording head units 1A and 1B provided on the carriage 3 moving in the direction (the main scan direction) intersecting the direction of carrying the recordable sheet S and performs a printing operation while moving the recording head units 1A and 1B in the main scan direction, but is not limited to this device. The aspect as shown in FIG. 1 may be what is called a line ink jet recording device which performs the printing operation only by carrying the recordable sheet S with the recording head being fixed.

In the aspect described above, the ink jet storage device is described as an example of a liquid ejecting apparatus, but covers all liquid ejecting apparatuses which include a big-sized liquid ejection head as targets. Therefore, the aspect may be also applied to a liquid ejecting apparatus which is equipped with the liquid ejection head ejecting a liquid other than ink. In addition, the liquid ejection heads include, for example, a variety of recording heads used in an image recording device such as a printer, a color material ejection head used in manufacturing a color filter, for example, for a liquid crystal display, an electrode material ejection head used in forming an electrode of an organic EL display, FED (Field Emission Display), and others, and an organic material ejection head used in manufacturing a bio chip.

What is claimed is:

1. A control method of controlling a liquid ejection head discharging liquid within a pressure generation room through a nozzle orifice by generating pressure change to the liquid within the pressure generation room with a pressure generation unit that is driven with a drive signal, the method comprising:

detecting a viscosity of the liquid; and driving the pressure generation unit with a drive signal based upon the detected viscosity of the liquid, wherein the drive signal includes a first drive signal and a second drive signal, wherein the first drive signal includes a prior pulse section including a first contraction element contracting the pressure generation room and a discharging pulse section including a first expansion element pulling in a meniscus by expanding the pressure generation room following the first contraction element and a second contraction element discharging a droplet of liquid from the nozzle orifice by contracting the pressure generation room following the first expansion element, wherein a second drive signal includes the discharging pulse section and a vibration control pulse section including a second expansion element controlling a residual vibration by expanding the pressure generation room following the second contraction element, wherein driving the pressure generation unit includes driving the pressure generation unit with the first drive signal when viscosity of the liquid is equal to or more than a first set value, and driving the pressure generation unit with the second drive signal when the viscosity is equal to or less than a second set value which is lower than the first set value, and wherein a sum of a first period from the starting point of the second expansion element to the ending point and a second period from the starting point of a leveling element during which the pressure generation unit is uniformly maintained, following the second expansion element, to the ending point, in the vibration control pulse section, is determined as ($^{5}/_{13}$) Tc to ($^{10}/_{13}$) Tc, when a cycle of natural vibration of the pressure generation room is defined as Tc.

2. The control method of controlling a liquid ejection head according to claim 1, wherein the drive signal includes a third drive signal including the prior pulse section, the discharging pulse section and the vibration control pulse section, and wherein driving the pressure generation unit includes driving the pressure generation unit with the third drive signal when the viscosity of the liquid is less than the first set value and exceeds the second set value which is lower than the first set value.

3. A control device for controlling a liquid ejection head discharging liquid within a pressure generation room through a nozzle orifice by generating pressure change to the liquid within the pressure generation room with a pressure generation unit that is driven with a drive signal, wherein the drive signal includes a first drive signal and a second drive signal, wherein the first drive signal includes a prior pulse section including a first contraction element contracting the pressure generation room and a discharging pulse section including a first expansion element pulling in a meniscus by expanding the pressure generation room following the first contraction element and a second contraction element discharging a droplet of liquid from the nozzle orifice by contracting the pressure generation room following the first expansion element, wherein a second drive signal includes the discharging pulse section and a vibration control pulse section including a second expansion element controlling a residual vibration by expanding the pressure generation room following the second contraction element, wherein the pressure generation unit is driven with the first drive signal when viscosity of the liquid is equal to or more than a first set value and the pressure generation unit is driven with the second drive signal when the viscosity is equal to or less than a second set value which is lower than the first set value, and wherein a sum of a first period from the starting point of the second expansion element to the ending point and a second period from the starting point of a leveling element during which the pressure generation unit is uniformly maintained, following the second expansion element, to the ending point, in the vibration control pulse section, is determined as ($^5/_{13}$) Tc to ($^{10}/_{13}$) Tc, when a cycle of natural vibration of the pressure generation room is defined as Tc.

4. The control device for controlling a liquid ejection head according to claim 3, wherein the drive signal includes a third drive signal including the prior pulse section, the discharging pulse section and the vibration control pulse section, and wherein the pressure generation unit is driven with the third drive signal when the viscosity of the liquid is less than the first set value and exceeds the second set value which is lower than the first set value.

5. A liquid ejecting apparatus comprising:

a pressure generation room filled with liquid;

a pressure generation unit causing a pressure change to the liquid within the pressure generation room by supplying a drive signal;

a liquid ejection head including a nozzle orifice from which the liquid within the pressure generation room is discharged according to the pressure change; and the control device for controlling the liquid ejection head according to claim 4.

6. The control device for controlling a liquid ejection head according to claim 3, wherein the relationship is D2≥D1 between a slope D1 of the first expansion element and a slope D2 of the second expansion element in the waveform of the drive signal.

7. A liquid ejecting apparatus comprising:

a pressure generation room filled with liquid;

a pressure generation unit causing a pressure change to the liquid within the pressure generation room by supplying a drive signal;

a liquid ejection head including a nozzle orifice from which the liquid within the pressure generation room is discharged according to the pressure change; and the control device for controlling the liquid ejection head according to claim 6.

8. The control device for controlling a liquid ejection head according to claim 3, wherein the relationship is D3≥D4 between a slope D3 of the second contraction element in the waveform of the drive signal and a slope D4 of a third contraction element that returns to its initial state following the leveling element of the vibration control pulse section.

9. A liquid ejecting apparatus comprising:

a pressure generation room filled with liquid;

a pressure generation unit causing a pressure change to the liquid within the pressure generation room by supplying a drive signal;

a liquid ejection head including a nozzle orifice from which the liquid within the pressure generation room is discharged according to the pressure change; and the control device for controlling the liquid ejection head according to claim 8.

10. A liquid ejecting apparatus comprising:

a pressure generation room filled with liquid;

a pressure generation unit causing a pressure change to the liquid within the pressure generation room by supplying a drive signal;

a liquid ejection head including a nozzle orifice from which the liquid within the pressure generation room is discharged according to the pressure change; and the control device for controlling the liquid ejection head according to claim 3.

11. A liquid ejecting apparatus comprising:

a pressure generation room filled with liquid;

a pressure generation unit causing a pressure change to the liquid within the pressure generation room by supplying a drive signal;

a liquid ejection head including a nozzle orifice from which the liquid within the pressure generation room is discharged according to the pressure change; and the control device for controlling the liquid ejection head according to claim 3.

* * * * *